United States Patent [19]

Baatz et al.

[11] Patent Number: 4,626,414

[45] Date of Patent: Dec. 2, 1986

[54] APPARATUS FOR THE PACKAGING OF RADIOACTIVE WASTES IN STORAGE CONTAINERS

[75] Inventors: Henning Baatz; Dieter Rittscher, both of Essen, Fed. Rep. of Germany

[73] Assignee: GNS Gesellschaft fur Nuklear-Service mbH, Essen, Fed. Rep. of Germany

[21] Appl. No.: 455,489

[22] Filed: Jan. 4, 1983

[30] Foreign Application Priority Data

Jan. 8, 1982 [DE] Fed. Rep. of Germany ..... 3200331

[51] Int. Cl.[4] ..... G21F 9/16

[52] U.S. Cl. ..... 422/159; 141/237; 252/626; 252/633; 422/903

[58] Field of Search ..... 422/159, 903; 252/626, 252/633; 159/DIG. 12; 141/237

[56] References Cited

U.S. PATENT DOCUMENTS

| | | | |
|---|---|---|---|
| 2,443,757 | 6/1948 | Allen | 141/237 |
| 4,234,448 | 11/1980 | Hirano et al. | 422/159 X |
| 4,235,739 | 11/1980 | Baatz et al. | 366/139 X |
| 4,246,233 | 1/1981 | Sheeline | 422/159 |
| 4,411,295 | 10/1983 | Nutter | 141/237 |

*Primary Examiner*—Barry S. Richman
*Assistant Examiner*—William R. Johnson
*Attorney, Agent, or Firm*—Karl F. Ross; Herbert Dubno

[57] ABSTRACT

Containers for the transportation and/or storage of radioactive wastes are filled by evacuating the containers and utilizing the vacuum thus generated to draw radioactive waste into the container. The radioactive waste is then dried in the container directly by continuing the vacuum and, if desired, heating the container with an electrical heater, the vapors thus produced being condensed before the withdrawn gas is filtered.

1 Claim, 3 Drawing Figures

APPARATUS FOR THE PACKAGING OF RADIOACTIVE WASTES IN STORAGE CONTAINERS

CROSS REFERENCE TO RELATED APPLICATIONS

This application is related to the commonly assigned copending applications Ser. No. 243,627 and Ser. No. 243,562 (now U.S. Pat. No. 4,445,042) of Mar. 13, 1981, to the copending application Ser. No. 279,332 (now U.S. Pat. No. 4,447,733) July 1, 1981, and to the copending application Ser. No. 396,883 which was filed July 5, 1982 as a continuation-in-part of now abandoned Ser. No. 127,098 of Mar. 4, 1980.

These applications were copending, in turn, or referred to one or more U.S. patents which are also commonly assigned herewith and are listed below:

U.S. Pat. No. 4,229,316
U.S. Pat. No. 4,235,739
U.S. Pat. No. 4,234,798
U.S. Pat. No. 4,273,683
U.S. Pat. No. 4,278,892
U.S. Pat. No. 4,288,698
U.S. Pat. No. 4,274,007

These patents and the art of record in the above identified applications and patents and the art cited therein or described by applicants or the patentees represent the best art known to the present applicants as to this subject matter.

FIELD OF THE INVENTION

Our present invention relates to an apparatus for the packaging of radioactive wastes and especially moist or damp radioactive wastes. More particularly, the invention relates to the packaging of radioactive wastes wherein the radioactive materials alone or with hardening agents or binders, are introduced in a moist or wet state into a container at least in part by the evacuation of the container and the induction of the radioactive waste in a flowable form into the container by the suction generated therein.

BACKGROUND OF THE INVENTION

As will be apparent from the literature identified above, the packaging of radioactive wastes is a well developed field in which care must be taken to minimize environmental contamination with the radioactive materials which are to be packaged for transport or storage. It is important in many cases to minimize the volume of material which must be handled and it has, therefore, been proposed to dry the radioactive wastes, e.g. by the evaporation of water therefrom.

The containers in which the wastes can be packaged can be, for example, massive iron structures in which the comparatively thick walls of the container constitute a shield against penetration by the radio nucleated decay particles or rays or can be equipped with cells or channels containing shielding materials with, for example, a enhanced neutron cross section.

The containers may be provided with binders in which the radioactive materials are captured to prevent them from leaching out of the containers should there be some damage to the containers with time. The containers are generally sealed to prevent the escape of any radioactive material.

The packaging of radioactive wastes in this manner can be utilized for the short-duration or temporary storage of the wastes, e.g. prior to reprocessing, or for the transportation of such wastes, e.g. from a nuclear power plant to a spent-fuel processing station or from a spent-fuel processing plant to a waste disposal site, or from a nuclear power facility directly to the waste disposal site.

Most commonly, however, the containers serve for the ultimate disposal of the radioactive wastes, i.e. to hold the wastes substantially permanently at the waste disposal site.

It is known to introduce such wastes, if desired together with a hardening or binding agent, into the containers, by first evacuating the containers, and then allowing the subatmospheric pressure which is thereby developed in the container to draw the radioactive waste into the container. Since the container may be maintained under suction during this process, gaseous and even gas-entrained substances are sometimes drawn off and passed through a filter or the like before being released into the atmosphere or subjected to some other treatment.

Up to now, to the extent that the radioactive waste has been moist or wet, the moisture is retained in the packaged product which has created a corrosion problem with time. The corrosion problem is especially pronounced because the normal decay of the radioactive material tends to raise the temperature within the waste-packaging container, the elevated temperature accelerating chemical corrosion or attack upon the walls of the container.

This has been recognized heretofore and hence it has been proposed to dry the product before introducing it into the container, in which case transfer into the container by vacuum as described is not possible or convenient.

OBJECTS OF THE INVENTION

It is the principal object of the present invention to provide an improved apparatus for the packaging radioactive wastes so that the disadvantages of earlier systems can be obviated.

Another object of this invention is to provide an improved apparatus for the packaging of radioactive wastes in a more convenient and simple manner, such that corrosion of the waste package is minimized.

Still another object of this invention is to provide an apparatus for the packaging of radioactive wastes which will allow more compact packaging at lower cost than heretofore with greater permanence of the packaged product.

SUMMARY OF THE INVENTION

These objects and others which will become apparent hereinafter are attained in accordance with the present invention by combining the vacuum transfer of the radioactive waste to the transport and/or storage container with a vacuum drying of the product within the container by maintaining the container connected to the suction source and, preferably, heating the container during the vacuum drying process.

The vapors and gases driven off from the container during the vacuum drying of the radioactive wastes therein are passed through a condenser and a filter before being discharged, the condenser condensing out any components which are nongaseous at temperatures below the temperature to which the container is heated.

Preferably the radioactive waste, after the filling of the transport and/or storage container or the charging thereof with the radioactive waste, is dried under some atmospheric pressure at the same place that the container was charged with the waste.

The heating means can be electric heating coils or loops disposed externally of the container although it is also possible to provide heaters within the containers or to utilize a hot fluid as a source of the drying energy.

According to another feature of the invention, between the suction unit (manifold) and the suction source, a condensate separator is provided to remove from the evacuated gas condensable components. According to the invention this condensate separator may have the configuration of a cyclone provided within the swirl region of the cyclone with a cooling device. The duct leading to the filter can extend from the top of the cyclone while a condensate discharge port is provided at the bottom of this unit.

According to another feature of the invention, the suction line to each container for the radioactive waste is provided with a baffle or like arrangement preventing particulates from the incoming stream from being entrained with evacuated substances. Among the advantages of the present invention is that the apparatus utilized for the vacuum filling of the containers can be exploited further to carry out vacuum drying of the moist or wet radioactive wastes, thereby reducing the volume of the material which must be packaged and at relatively low cost, increasing the security of the packaged wastes by reducing the tendency toward collection. The vacuum drying directly within the containers at the place at which they are filled with the radioactive waste minimizes danger to the environment and permits intensive drying in short periods of time.

When the containers are composed of cast iron or like metal structures, the heating is especially efficient.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
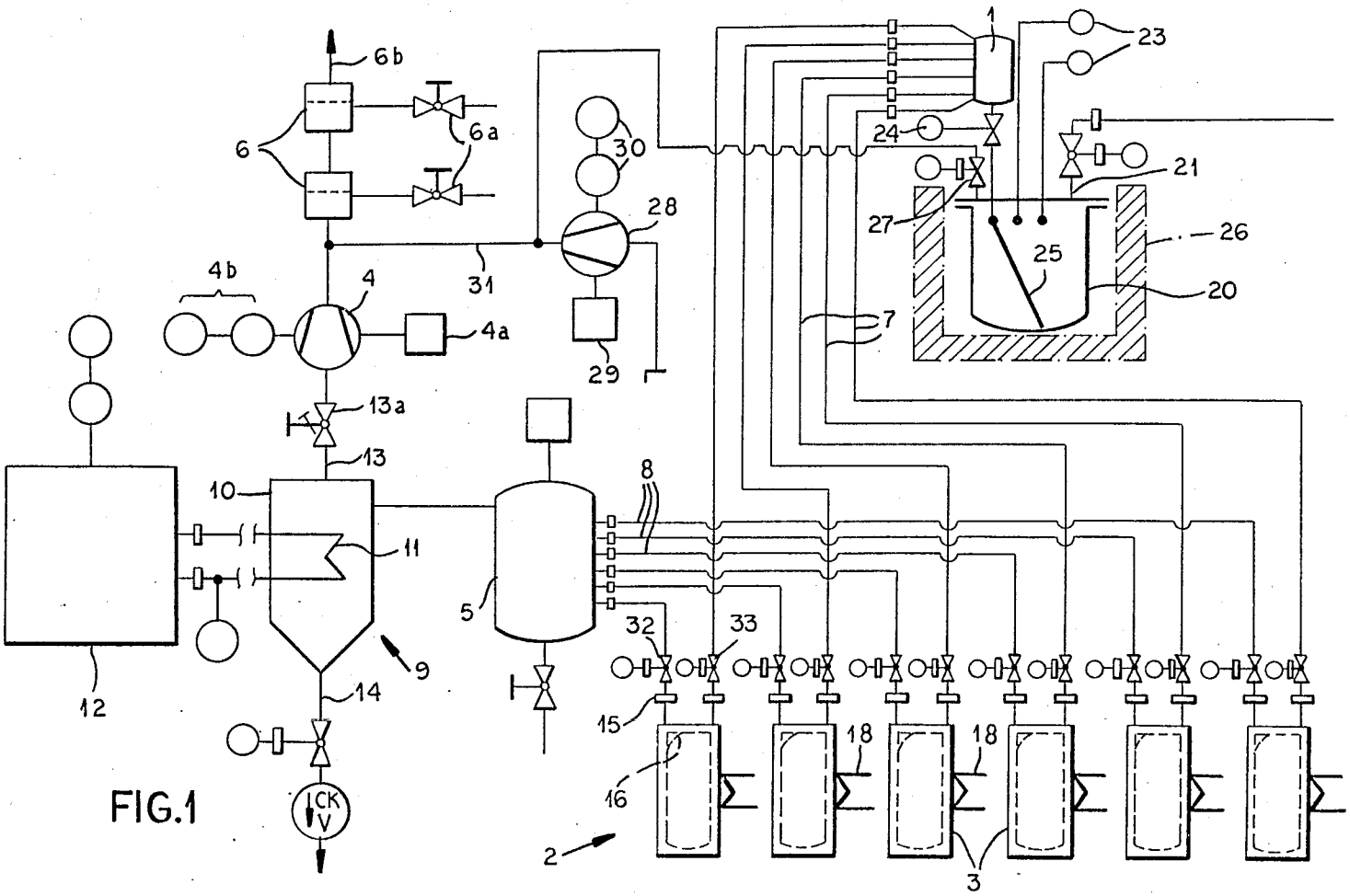
FIG. 1 is a flow diagram illustrating an apparatus for carrying out the method of the invention.

The apparatus shown in FIG. 1 comprises a metering device 1 and filling station 2 adapted to receive the sealable transport and/or storage containers 3, six of which are shown to be filled simultaneously using a common suction source 4 and a second filling device 5. A filter unit 6 is provided downstream of the suction source 4.

The containers 3 in the charging station 2 are connected by pipes 7 and 8, respectively with the metering or dosing unit 1 and with suction distributing unit 5.

Between the suction distributing unit 5 and the suction source 4 we provide a condensate removal unit 9. The latter has a configuration of a cyclone provided internally with a cooling coil 11 which is brought to a reduced temperature by a refrigerator unit 12. The coolant circulating in line 11 can be the refrigerant or can be brine or some other heat-transfer liquid which, in turn, is cooled by heat exchange with a refrigerant.

The gas outlet duct 13 extending axially from the top of the condensate separator, communicates via a valve 13*a* with the suction source 4 which is driven by a motor 4*a*. Gauges 4*b* are provided to indicate the operating state of the suction source.

The outlet side of the suction pump 4 is connected to the filters 6, two of which are provided in tandem and each of which has a valve 6*a* for discharging collected material.

The gas may be discharged at 6*b* for further processing and if it is not radioacative, directly into the atmosphere.

The bottom of the cyclone 10 is formed with an outlet 14 for the condensate.

Each container 3 is connected by a fitting 15 to the suction line 8 of the suction distributor 5 and is provided ahead of this suction outlet with a baffle 16 which is provided to prevent spattering of portions of the radioactive material from inlet line 7 into the exhaust vapors.

The radioactive waste, which can be combined with a hardener, is previously introduced into a tank 20, e.g. via line 21, after evacuation of this tank by means not shown. The pressure and temperature conditions in the tank may be monitored by gauges 23.

The metering unit 1, which can be formed as a small tank receiving an appropriate charge of the radioactive material, is connected by a valve 24 with a suction tube 25 reaching into the tank 20 which can be stored in a shielded well 26.

Pressure can be applied upon the radioactive waste in the tank 20 via a valve 27 and a compressor 28 driven by motor 29 and having gauges 30 for monitoring its performance. When the suction source 4 is deactivated, the compressor 28 via line 31 can drive collected material from the filter 6 via the valves 6*a* previously described.

Assume, first, that the containers 3 are evacuated by suction drawn by the suction pump 4 through the valve 13*a*, the condenser 9 and the suction tank 5, as well as through valves 32 connecting each container to the respective line 8.

Valve 24 is then opened to admit an appropriate quantity of radioactive waste, which previously can have been mixed with a binder, to the metering unit 1, whereupon a valve 33 is opened to permit the waste to be transferred by suction to the container 3.

The waste is usually in a moist or wet state and is flowable so that it can be transferred, in part, by pressure applied to the tank 20 via valve 27.

Prior to transfer of the slug of radioactive waste to the container 3, the latter was evacuated and the evacuation continues during the transfer.

Simultaneously, gaseous substances, which may entrain dust, are subjected to filtering in the units 6.

After the containers 3 have been charged, the suction source 4 continues to apply the vacuum while the containers are heated, e.g. by the electrical heating units 18, to dry the radioactive wastes within the containers.

The vapors are subjected to condensation in the unit 9, the condensate is recovered and the remaining gas filtered at 6.

Figure 2:
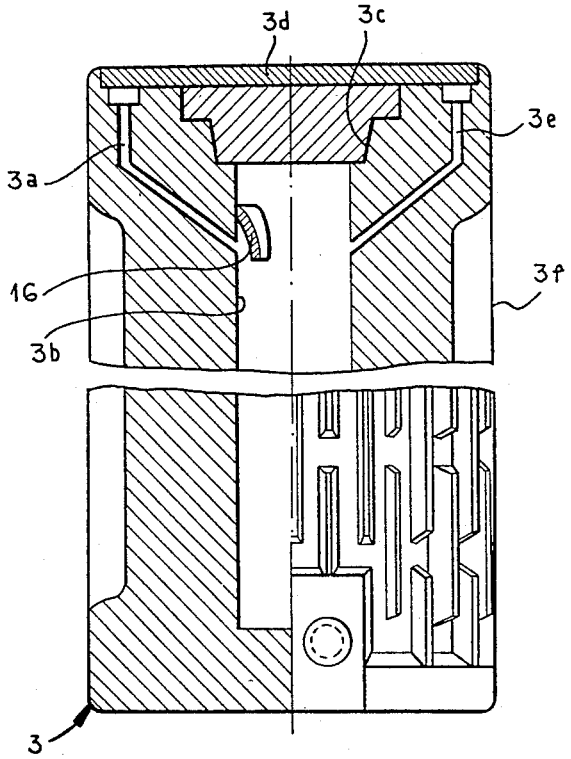
FIG. 2 is a partial section through a container which may be used with the method of the invention.
Figure 3:
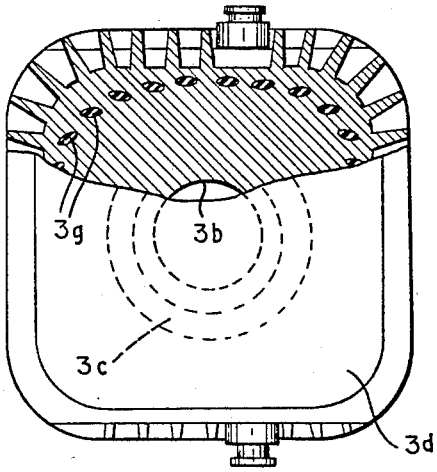
FIG. 3 is a transverse section through this container.

In FIGS. 2 and 3, we have shown a container 3 in which the radioactive waste can be stored or transported in accordance with the principles of the aforementioned patents.

The container 3 can be composed of spherulitic cast iron, cast steel or the like and can be sealed with a plug-type cover 3*c* and appropriate "O"-ring and/or metal-to-metal weld seams.

A passage 3*a* through which the vapors can be drawn and a passage 3*e* through which the radioactive waste is admitted can be formed in the container and sealed by a safety cover 3*d* which can be bolted or welded in place. The space 3*b* receiving the radioactive waste can be surrounded by fins 3*f*, which allow heat dissipation during radioactive decay and increase heat transfer to the waste during the drying step.

Before the container is sealed, compartment 3*g* can be filled with material of high neutron cross section.

All of the other containers and container-cover arrangements of the aforementioned applications and patents can likewise be used.

The valves 32 and 33, and indeed all of the valves previously described, can be automatically operated by remote control means conventional in the art and requiring no detailed description here.

It suffices to note that the valves 32 and 33 can be operated sequentially to evacuate each of the containers in succession and transfer respective slugs of radioactive material to them, while suction is then maintained through the tank 5 so that the radioactive material in all of the containers can be dried simultaneously.

We claim:

1. An apparatus for the packaging of radioactive waste in storage containers, comprising:

a plurality of storage containers, each being fitted with an internal baffle for preventing incoming radioactive waste from spattering into fluid suctioned from said containers;

a suction source attached to each of said containers for evacuating each of said containers and imparting a vacuum therein;

a source of radioactive waste;

means for introducing said radioactive waste into said containers, said introducing means at least in part caused by the vacuum present within said containers wherein said introduction means comprises, a metering unit connected to and located between said radioactive waste source and each of said containers, a sequentially operable valve means for tranferring slugs of radioactive waste to said containers, said valve means located between said containers and said metering unit, wherein more than one storage container can be simultaneously filled utilizing the single suction source;

a heating unit attached to each of said containers for drying said radioactive waste therein while the suction on said containers is maintained by said suction source;

a condenser connected between said suction source and said containers for condensing vapors arising from said containers after the filling thereof, whereby the radioactive waste in said containers is dried during the maintenance of suction by said source, said condenser comprising a cyclone which is provided internally with a cooling coil and which has an upper outlet connected to said source and a condensate outlet at the bottom of said cyclone;

a filter connected to said suction source for filtering gas from which condensate has been separated;

a refrigerating unit connected to said cooling coil;

a tank connected between said containers and said cyclone; and means for connecting each of said containers to said tank.

* * * * *